United States Patent [19]

Wilson

[11] 4,173,358

[45] Nov. 6, 1979

[54] ACCESSORY CLIP AND PAGE SEPARATOR FOR NOTEPADS AND THE LIKE

[76] Inventor: Richard C. Wilson, P.O. Box 26, Champlin, Minn. 55316

[21] Appl. No.: 880,396

[22] Filed: Feb. 23, 1978

[51] Int. Cl.[2] ..... B42F 1/00

[52] U.S. Cl. ..... 281/45

[58] Field of Search ..... 281/42, 45

[56] References Cited

U.S. PATENT DOCUMENTS 155,196 9/1874 McNair ..... 281/42 X

FOREIGN PATENT DOCUMENTS 511924 4/1955 Canada ..... 281/42

197647 4/1907 Fed. Rep. of Germany ..... 281/42

*Primary Examiner*—Robert L. Spicer, Jr.

*Attorney, Agent, or Firm*—Warren N. Low

[57] ABSTRACT

A clip assembly for wallet-like articles carried upon the person such as notebooks, daily calendars, writing pads and the like, wherein an accessory clip is firmly but detachably affixed to the cover of the article and carries a readily available writing instrument. An auxiliary clip associated therewith serves as a page separator or hold-down for use on the pages within the wallet as well as providing a mount for a slidable nomographic reference member such as a calendar.

13 Claims, 9 Drawing Figures

ACCESSORY CLIP AND PAGE SEPARATOR FOR NOTEPADS AND THE LIKE

BACKGROUND OF THE INVENTION

It is customary for many persons in all walks of life to carry a thin, flat wallet-like folder or enclosure for a checkbook, notebook, reminder pad or the like. Such pocket-size wallets or tablets are quite convenient and are immediately available to the user for appropriate notes, reference, or other written entries.

With multi-paged pads such as a checkbook, check register, or a daily calendar, for example, it is highly desirable to have the pocket wallet readily open to a desired page for the current activities requiring written entry or notation.

It will be appreciated that considerable inconvenience is experienced in pulling out a pocket notebook or the like, opening the same, and necessarily turning page-by-page to the desired current page for entries and thereafter additionally to discover that no writing instrument is readily available on the person.

SUMMARY OF THE INVENTION

The present invention uniquely provides an accessory clip for a pocket-carried notebook or like wallet item which compactly disposes a writing instrument in attached juxtaposition to the notebook and wherein further the accessory clip includes auxiliary means for permitting the wallet to open to a selected page.

To this end, the accessory clip includes mounting means comprising a backing or base member on one side and two leg-like tabs on the other frictionally engaging the wallet cover which is normally relatively rigid relative to the pages therewithin, and wherein the clip is provided with an affixed receptacle for a writing instrument such as a pencil, felt pen, or the like.

Further, the spacing of the retaining tabs of the accessory clip is such that a further auxiliary clip may be received and retained therebetween for purposes of holding down and separating a selected group of pages in the notebook whereby the same may be readily opened immediately to the desired page.

Further, the auxiliary clip provides an adjunctive means for carrying a calendar or like nomographic indicator device capable of relative sliding movement with respect to the clip to expose desired indicia.

DETAILED DESCRIPTION OF THE INVENTION

Figure 1:
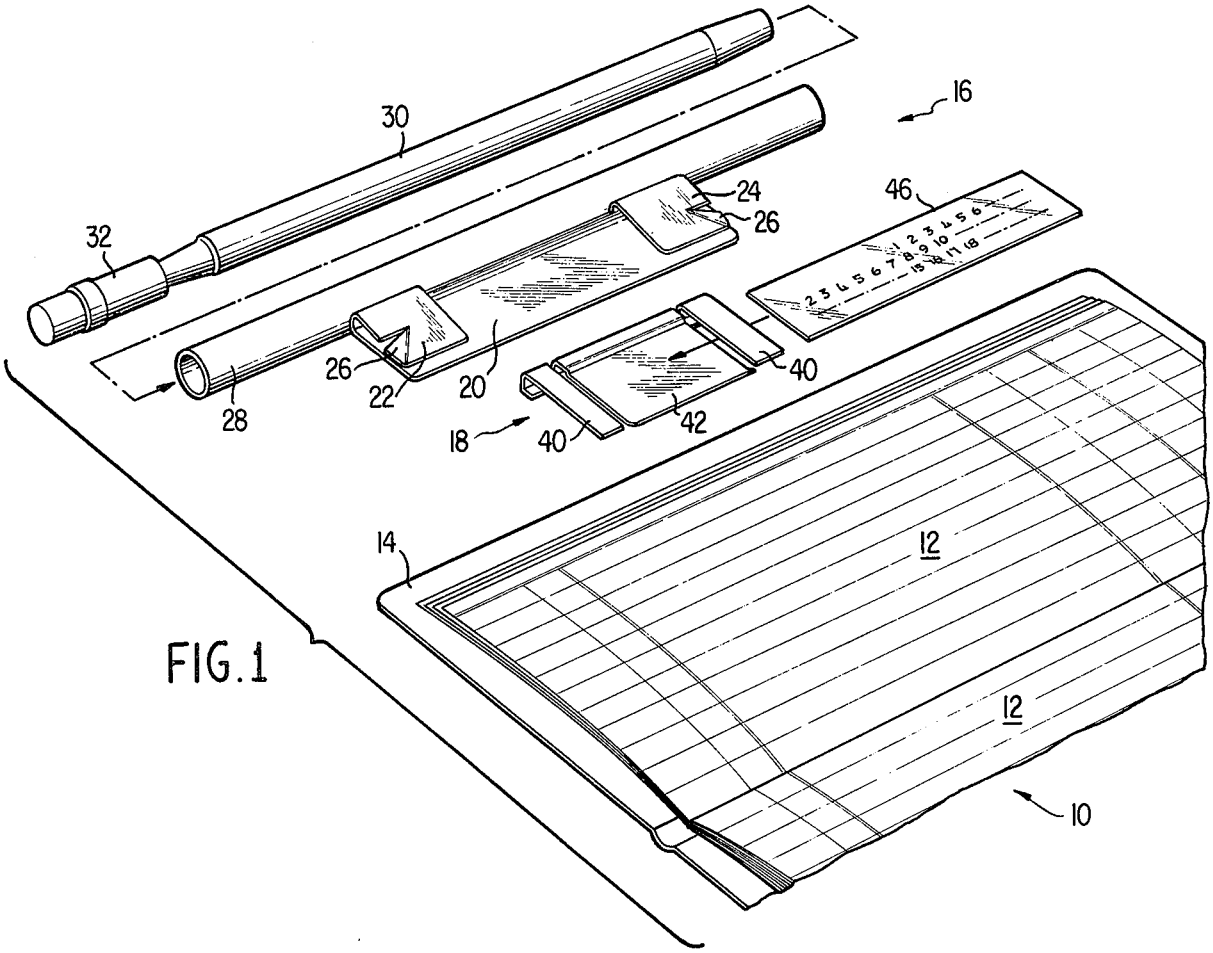
FIG. 1 is an exploded view of the invention showing the accessory clip with tubular receptacle thereon for a writing instrument, the accessory clip, the slide, and an associated notebook or wallet.

Referring to the drawings, the accessory clip assembly of the present invention is utilized in conjunction with a conventional thin, flat pocket-carried wallet such as a notebook, check book or the like 10 and which may include therewithin a plurality of individual pages 12 as in the instance of a daily calendar or a check register, for example.

Such notebook leaves or pages 12 are commonly received within a decoratively printed and somewhat more rigid external enclosure cover of vinyl, cardboard, etc., and from which the internal pages 12 may be replaced as necessary while cover 14 protects the interior pages when carried during handling in the usual manner.

Figure 2:
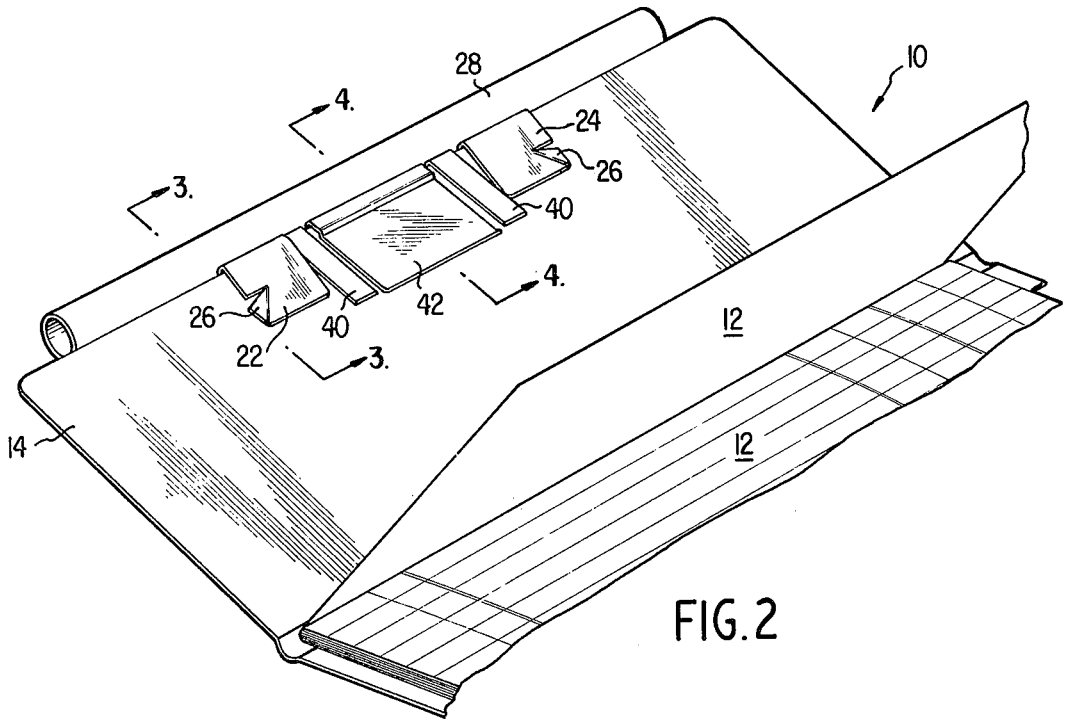
FIG. 2 discloses the parts in assembled relation with the writing instrument and the auxiliary slide indicator removed therefrom.

The clip assembly of the present invention is detachably associated with the cover 14 and individual pages 12 of the wallet and includes an accessory clip 16 for a writing instrument 30 and an auxiliary clip 18 for a page hold-down. The writing instrument clip assembly 16 includes planar base member 20 which is to be received against the outside face of a cover 14 and wherein spring-like retaining tabs 22, 24 are affixed to and extend from base 20 in laterally spaced relation therealong into overlying relationship with the inside face of wallet cover 14 as seen in FIG. 2. Conveniently, the clip member may be formed from a single U-shaped stamping of thin brass or the like wherein the legs or tabs 22, 24 are reversely folded slightly more than 180° to overlie base 20 and be resiliently deflectable away therefrom.

In the form of the invention as seen in FIGS. 1 and 2, the tabs 22, 24 may each be provided with a struck-down tang 26 at one edge of the tab, the pointed end of which frictionally engages inside cover 14 thereby to resist accidental dislodgement or removal of the accessory clip 16 from the wallet cover 14. Retrograde movement of the clip assembly 16 will tend to cause the point of tang 26 to bite into the cover material and lock the same against accidental removing movement. While the clip assembly may be readily deliberately removed by appropriate flexure of the cover or tabs and sliding of the clip by the user, in the form of the invention shown with the tangs 26 facing in opposite directions, accidental detachment of the clip is unlikely.

Figure 7:
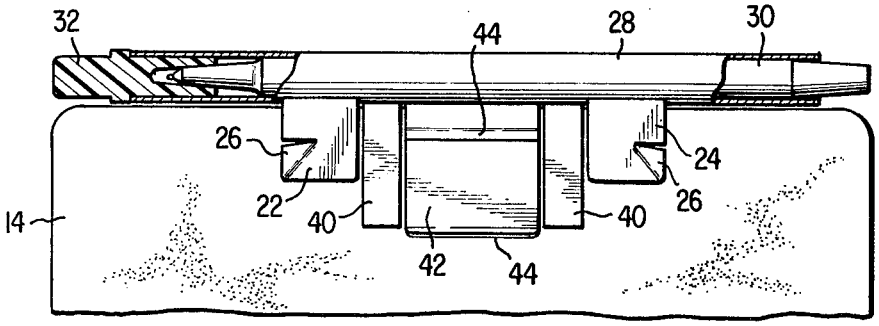
FIG. 7 is a top plane view of the several parts in assembled relation excepting the slide indicator, and with the tubular receptacle partially in section to show the writing instrument therewithin.

Suitably affixed to the clip member is an elongated tube 28 for reception therewithin of a writing instrument such as a pencil, ballpen, or felt pen 30. In the illustrated embodiment, the felt pen is frictionally received within a tube closure cap 32 which in turn is frictionally received within the receptacle 28 up to its stop shoulder as clearly seen in FIG. 7, for example. Preferably, as shown, receptacle 28 is shorter than the writing instrument 30 whereby the latter may be readily grasped at its end.

Figure 3:
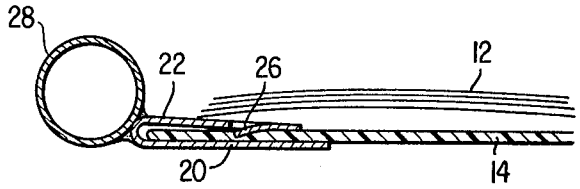
FIG. 3 is a sectional side elevation taken along the lines 3—3 of FIG. 2.
Figure 4:
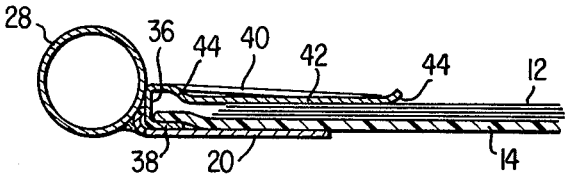
FIG. 4 is a sectional side elevation taken along the lines 4—4 of FIG. 2.
Figure 5:
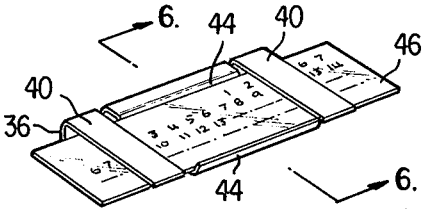
FIG. 5 is a perspective view of the auxiliary page separator clip with the slide indicator thereon.

The tube 28 within which the writing instrument 30 is received may be affixed to the clip as by adhesives or, preferably, in the instance of brass as by soldering as seen in FIGS. 3 and 4, whereby the entire clip assembly 16 is readily unit-handled in applying the same to a wallet member 10.

For durability as well as ready manufacture, the clip portions 20, 22, and 24 as indicated may be formed of thin springy metal such as brass, although other materials including plastics may be employed. Likewise, tube 28 may be formed of plastic.

Figure 8:
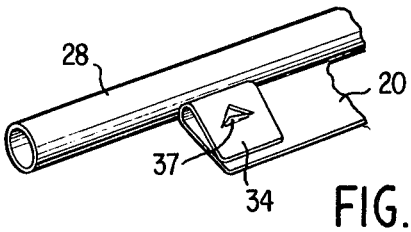
FIG. 8 is a fragmentary perspective view of a modified form of securing tang.

FIG. 8 illustrates a modified form of securing tang on the tab to releasably lock the clip onto cover 14 wherein the tab 34 is provided with a downwardly struck and outwardly facing tang 36 lying fully within the peripheral boundary or edges of the tab 34 so as to minimize accidental engagement thereof with the finger of the user.

Figure 9:
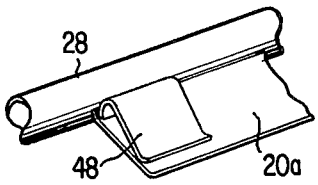
FIG. 9 is a fragmentary perspective view of a further modified form of the retaining tab.

Other means of securing the clip assembly 16 to the wallet cover 14 may be employed within the scope of the invention, including, for example, highly preloaded spring tab means having no struck tangs therein and which would have the appearance generally speaking of a smooth tab as at 48 in FIG. 9. In this form of the invention, the tab 48 may be separate from the clip base portion 20A and secured thereto as by solder adjacent solder connection of base 20 to tube 28. The tab member may be shaped or peened as necessary to exert requisite spring pressure against the cover 14 held thereby. In manufacture, the tab 48 is held compressed along its span center until soldered thereby to provide a prestressed clip effective in attachment to minimum thickness covers. A prestress condition can also be obtained by peening the periphery of the fold in a one-piece construction while the tab is compressed.

Accordingly, it will be seen that the structure of clip assembly 16 in the several embodiments simply and effectively provides a means for providing a writing instrument in conventient proximity to a wallet pad or the like while not adding materially to the bulk thereof, wherein the tube 28 lies parallel to and along the edge of the notebook 10 and wherein further the relative thinness of the attaching clip members 20, 22, 24 renders the same unobtrusive.

Figure 6:
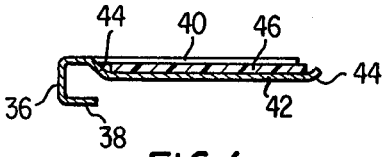
FIG. 6 is a sectional side elevation taken on the line 6—6 of FIG. 5.

The page-holding auxiliary clip 18 is likewise preferably formed from a single blank of material such as thin brass having springy characteristics and in cross section is of substantially J-configuration as seen in FIG. 6.

The J- or U-shaped edge of the clip includes rear wall 36 and a short terminal flange 38 which as seen in FIGS. 2 and 4 loosely hooks around the edge of wallet cover 14 whereby the clip 18 is confined against lateral movement outwardly of the wallet by virtue of the pencil cylinder 28 abutting thereagainst. Similarly, the clip 18 cannot move laterally to the right or left by virtue of its position between the tabs 22, 24 of the accessory clip assembly 16.

The auxiliary clip 18 includes forwardly extending legs 40 at its extremities and disposed therebetween is a central panel 42 which is dished into a shallow channel having flanges 44 on either side thereof.

The tabs 40 and the central channel 42 normally lie substantially in the same plane as seen in FIG. 4 whereby the inherent resiliency or springiness of the material provides a means for holding a slide member 46 having suitable indicia thereon useful to the notebook owner. In the illustrated embodiment, calendar numbers are shown on slide 46 whereby when it is confined in channel 42 and beneath springy tabs 40, selected days of the week are exposed. By sliding the member 46 as desired in channel 42 the number arrangement may be accomodated to the differing months of the year as is known in the art. Alternatively, any other useful data upon slide member 46 might be employed carrying legends of information of diverse alphnumeric types such as metric conversion data, decimal equivalents, etc.

The springiness of the legs 40 cause the slide member 46 to be firmly but slidably gripped therebetween whereby the same will not inadvertently or accidentally fall from or be dislodged away from the auxiliary clip 18.

Further the tabs 40 and central panel 42 provides the primary function of a page or leaf hold-down as seen in FIG. 4 whereby those notebook pages 12 that are no longer needed for quick reference may be inserted under the auxiliary clip 18 whereby when the wallet 10 is opened, the same falls immediately open to a desired page for reference or use, while pages may be readily additionally placed under or withdrawn from the member 42, 44 as desired.

While I have described my invention in conjunction with a pocket-carried notebook or checkbook, the accessory clip 16 and auxiliary clip 18 may also find beneficial utility for other and larger articles, such as clipboards, textbooks and the like without departing from the invention.

What I claim is:

1. An accesory clip assembly for a pocket-carried notepad article or the like comprising a clip having means for detachably securing the same to a portion of a said article, a tubular member affixed to said clip for reception therewithin of a writing instrument, said clip including cooperating base and tab members for gripping a said article portion therebetween to prevent accidental dislodgement thereof from the article, wherein said tab member has a sharpened tang depending therefrom and extending toward said base member whereby the same fricitionally engages with a said article with the tang biting thereinto.

2. The assembly of claim 1 wherein said tubular member is soldered to said clip.

3. The assembly of claim 1 wherein said tubular member is adhesively bonded to said clip.

4. The assembly of claim 1 wherein a second tab member is disposed in cooperative overlying relation to said base member and in laterally spaced relation to said first tab member.

5. The assembly of claim 4 further including an auxiliary page-separating clip interposed between said tab members and adjacent said tubular member for cooperative association with a said article in overlying and holding the pages thereof.

6. The assembly of claim 5 wherein said page-separating clip includes a U-shaped portion along one side thereof for engaging an edge of a said article.

7. The assembly of claim 6 further including laterally spaced spring tab members on said page-separating clip, a channel-shaped portion therebetween, and a slide member disposed between said tab members and said channel-shaped portion to be frictionally held thereby in slidable relation thereto.

8. The assembly of claim 1 wherein said tang is struck downwardly from an edge of said tab members.

9. The assembly of claim 1 wherein said tang is struck downwardly from a central portion of said tab members.

10. The assembly of claim 1 wherein a frictional plug closes one end of said tubular member, said plug including frictional receiving means for a writing instrument, thereby to hold said instrument in said tubular member for ready access.

11. The assembly of claim 1 wherein said clip is formed from a single sheet of thin resilient metal.

12. The assembly of claim 1 wherein said tab member is secured to said base member adjacent an edge thereof and inclines downwardly toward said base member to terminate at its free end in an upturned nose.

13. The assembly of claim 12 wherein said tab member is prestressed to effect resilient engagement with said base member adjacent said tab free end.

* * * * *